US005425591A

United States Patent [19]

Contreras et al.

[11] Patent Number: 5,425,591

[45] Date of Patent: Jun. 20, 1995

[54] DISPOSABLE TOOTHBRUSH

[76] Inventors: Thomas J. Contreras; Norma I. Padro, both of 2222 N. Harlem Apt. #6, Elmwood Park, Ill. 60635

[21] Appl. No.: 243,698

[22] Filed: May 17, 1994

[51] Int. Cl.[6] ..... A46B 11/02

[52] U.S. Cl. ..... 401/191; 401/123; 401/117; 401/153; 401/184; 401/268; 401/269; 132/308; 132/311

[58] Field of Search ..... 401/153, 191, 117, 269, 401/268, 123, 183, 184; 132/308, 311

[56] References Cited

U.S. PATENT DOCUMENTS

| | | | |
|---|---|---|---|
| 2,299,572 | 10/1942 | Estenes | 401/153 X |
| 2,455,600 | 12/1948 | Molumby et al. | 132/311 X |
| 2,620,810 | 12/1952 | Van Handel | 401/191 |
| 2,743,042 | 4/1956 | Burgin | 401/184 X |
| 2,756,450 | 7/1956 | Stolarevsky | 401/191 |
| 4,128,349 | 12/1978 | Delbon | 401/153 X |

FOREIGN PATENT DOCUMENTS

| | | | |
|---|---|---|---|
| 610812 | 9/1926 | France | 401/191 |
| 1243534 | 9/1960 | France | 401/191 |
| 2658400 | 8/1991 | France | 401/123 |

*Primary Examiner*—Steven A. Bratlie
*Attorney, Agent, or Firm*—Paul H. Gallagher

[57] ABSTRACT

A brush head mounted on a handle that is tubular and forms a reservoir for the toothpaste. The reservoir is closed to the brush head, and at its rear end has a nozzle. The handle includes a flexible member which is bent to move the nozzle onto the bristles of the brush head. A removable cap normally closes the nozzle. In one form an enclosure sleeve encloses the handle and flexible member. A cap is removably mounted over the brush head.

10 Claims, 2 Drawing Sheets

DISPOSABLE TOOTHBRUSH

FIELD OF THE INVENTION

The invention resides in the general field of disposable toothbrushes. A toothbrush is pre-loaded with toothpaste, and ordinarily carried by the person, and used when desired. Such a toothbrush may contain sufficient toothpaste for a single use, or repeated uses, instead. The toothbrush itself when manufactured is of course sealed, and it includes a removable cap for resealing it after use, in the case where it is made for repeated use.

SUMMARY OF THE INVENTION

The disposable toothbrush of the present invention is preloaded in the manufacture thereof, with toothpaste. It is of such size as to contain sufficient toothpaste for repeated uses, and is of special design so as to occupy a minimum of space, notwithstanding its capacity for sufficient toothpaste for repeated uses.

An object of the invention is to provide such a disposable toothbrush that assumes a normal position in which it has a straight portion forming a handle, and can be bent for applying toothpaste therein to the bristles.

The toothbrush includes a reservoir containing the toothpaste, and it includes a flexible portion enabling expulsion of the toothpaste pursuant to a pumping action that results from alternate expansion and contraction of the flexible portion. This pumping action may take place at least partially in the bending of the toothbrush for applying the toothpaste to the bristles, but more particularly by alternate expansion and contraction of the flexible portion.

The flexible portion of the toothbrush is provided by a bellows which constitutes a segment of the length of the toothbrush, and it enables the bending referred to. However, the toothbrush includes other segments, in additional to the bellows, which cooperate in producing an elongated handle portion that has a certain degree of rigidity to facilitate holding the handle portion in the hand in using the toothbrush.

Another feature is the inclusion of an enclosure sleeve on the handle and main part of the toothbrush, that is extendible and contractible, and when in contracted position it exposes the flexible portion, and when in extended position it covers and protects the flexible portion, and it can be utilized as a substantially completely rigid handle.

BRIEF DESCRIPTION OF THE INDIVIDUAL FIGURES OF THE DRAWING

Figure 1:
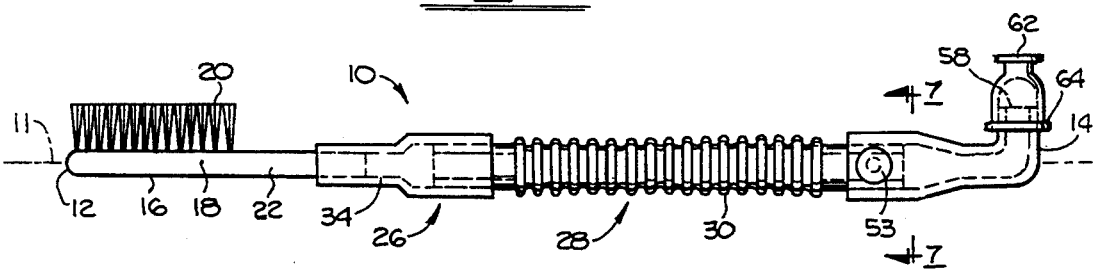
FIG. 1 is a side view of the toothbrush in normal straight position.

Referring in detail to the drawings, the toothbrush of the invention is shown in its entirety at 10, having a longitudinal direction indicated by the axis 11, and for convenience, is referred to as having a front end 12 and a rear end 14. The toothbrush includes a brush head 16 at the front end which includes a back element 18 having bristles 20 thereon, extending laterally from the longitudinal direction. The toothbrush may be made of any desired material, but preferably plastic, in its various forms, including the bristles 20.

The brush head 18 has a stem or base portion 22 by which it is mounted in the toothbrush as a whole. The stem 22 is dimensioned and shaped for structural purposes for mounting it, and may include an enlarged mounting element 24 preferably cylindrical in shape.

The toothbrush 10 includes a handle portion 26 which makes up the greater part of its length, and contains a mid-section 28 which includes a bellows 30, or corrugated tubular member.

The mid-section 28 includes a tubular fitting or adapter 32 which has a forward end 34 press fitted on the element 24. The adapter leads rearwardly into a larger tubular element 36 preferably cylindrical.

The bellows 30 is incorporated in a unit that includes front and rear stems or mounting elements 38, 40 integral with the bellows element. The bellows element in itself is of known structure providing an internal cavity 42 forming a reservoir for the toothpaste.

The front fitting 38 is tubular, and cylindrical, and press fitted in the cylindrical element 36. The front end of the fitting 38 is closed by a plug 44. The rear fitting 40 is tubular, and cylindrical, and its rear end 50 is open.

At the rear of the handle portion, and connected with the fitting 40, is a rear adapter 52 having a front tubular element 54 press fitted on the rear fitting 40. This rear adapter includes radial knobs or extensions 53 which are helpful in handling the toothbrush as referred to below.

The adapter 52 defines an exit passage 56 for the expulsion of toothpaste, and terminates in an aperture or nozzle 58 at the rear, opening to the exterior. The adapter 52 is preferably reduced in diameter, progressing rearwardly, for convenience, and for providing a reduced dimension nozzle 58 and preferably is bent at 60 forming a segment extending laterally.

A cap 62 is releasably applied to the segment 60, by a press fit, but which can be removed by the fingers. A bead 64 may be provided for forming a limit for the cap.

Figure 2:
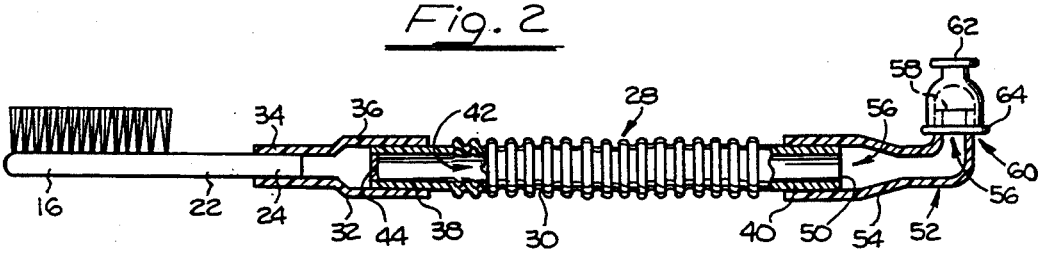
FIG. 2 is a longitudinal axial sectional view of the toothbrush of FIG. 1.
Figure 3:
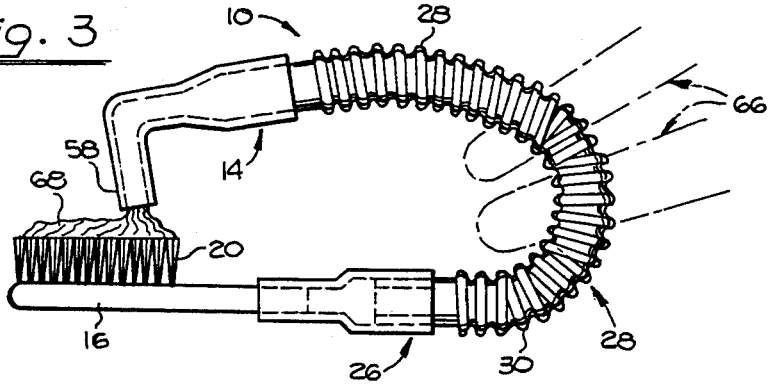
FIG. 3 is a side elevational view of the toothbrush in its position in applying the toothpaste to the bristles.

In the manufacture of the toothbrush, the toothpaste is placed in the reservoir 42, and in the passage 56, to the extent desired. The toothbrush when so produced, is normally in straight position as shown in FIGS. 1 and 2, and it includes the cap 62 applied thereto. In the use of the toothbrush the user removes the cap 62 and bends the rear part of the handle portion into doubled-over position shown in FIG. 3. The bellows element 30 enables this bending over, but it will be understood that all of the other parts are rigid, i.e. relatively rigid when considered in handling and using the toothbrush. The nozzle 58 is then applied to the bristles as shown in FIG. 3, and the bellows element is compressed or collapsed. FIG. 3 shows the user's fingers at 66 indicating such compressing action. The compressing and relaxing steps result in a pumping action. In these steps, the knobs 53 referred to above, may be engaged by the hand and held in bent-over position, to facilitate the manipulation thereof.

After applying the desired quantity of toothpaste on the bristles, as indicated at 68, the handle portion is released, and it assumes its normal longitudinally straight position, this step being accomplished by the self-biased condition of the bellows. As will be understood, the bellows, although being flexible, is biased to a straight position.

In addition to the manual pumping by the hand, the bending over of the handle produces a pumping action and produces a certain degree of compressing. This latter action is usually to a minor degree, and consequently the pumping of the bellows element by the hand is relied on for the most part in applying the toothpaste to the bristles.

Figure 4:
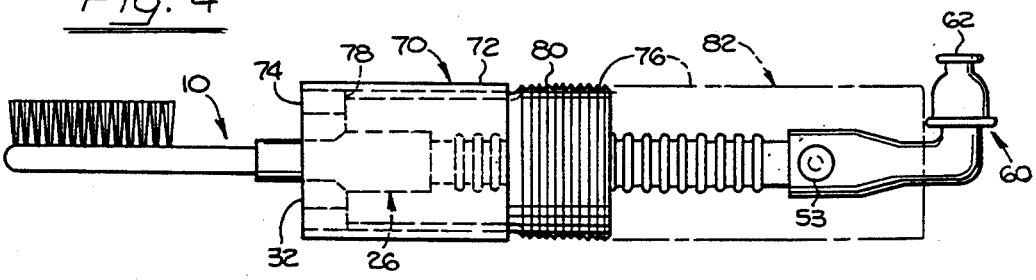
FIG. 4 is a view similar to FIG. 1 with an outer collapsible sleeve on the handle.
Figure 5:
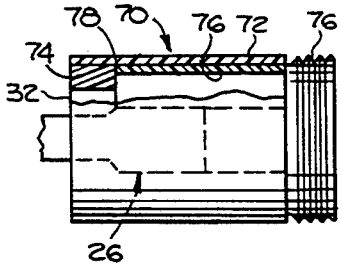
FIG. 5 is a fragmentary view of the left hand portion of the sleeve of FIG. 4 showing its mounting on the structure of the toothbrush.
Figure 6:
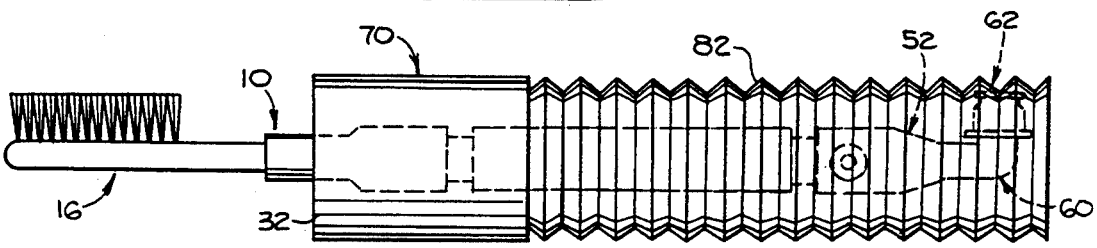
FIG. 6 is a view similar to FIG. 4 but showing the outer sleeve in fully stretched out position.
Figure 7:
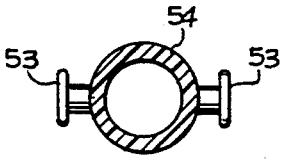
FIG. 7 is view taken at line 7—7 of FIG. 1.

FIGS. 4–6 show an additional feature of the invention. These figures show the toothbrush of the foregoing construction provided with an outer enclosing sleeve 70. This sleeve 70 includes an end ferrule 72 which may be of rigid construction, mounted on the front adapter 32, including insert elements 74. This ferrule may be cylindrical and smooth and is rigid. Included in the enclosing sleeve is a bellows or corrugated tubular element 76 having its front end extended into the ferrule 72 and secured thereto at 78 in a suitable manner. This outer sleeve is also preferably of plastic and the material thereof is rigid in radial directions, but the elements of corrugation thereof can be flexed longitudinally of the toothbrush for moving it into a collapsed compact position at 80 in which the elements are compacted together, and into an extended position 82. In one form of the construction, as in FIG. 4, the outer enclosing sleeve may be extended to the rear segment 60. FIG. 6 shows another form in which the sleeve may be extended ever the segment 60, and beyond all of the other elements of the toothbrush handle.

This outer enclosing sleeve protects the toothbrush. It is moved to compacted or collapsed position as shown in FIG. 4 and then the regular corrugated element 28 is bent and manipulated as described above, and represented in FIG. 3. Thereafter the corrugated element 28 is released and assumes its normal straight position, described above. In the latter position, and in the use of the toothbrush, the outer enclosing sleeve is extended to its full position, as in FIG. 6, and the sleeve then serves as a handle. The outer sleeve although flexible longitudinally, is relatively strong and somewhat rigid otherwise, and can be easily gripped by the hand and used as a handle.

Figure 9:
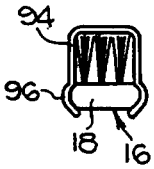
FIG. 9 is an end view taken at line 9—9 of FIG. 8.
Figure 8:
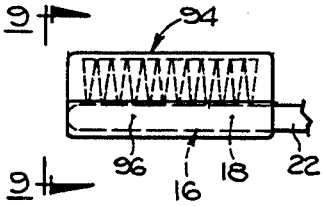
FIG. 8 is a view of the brush head with a cover over the bristles.

The invention also includes the feature of a separate cover for the brush head. This construction is shown in FIGS. 8 and 9, where the cover includes a longitudinal inverted U-shape element 94 having beads 96 with inner grooves which receive and grip the back element of the brush head. This cover slides onto the brush head in covering position, and slides therefrom in removing it.

The toothbrush is inexpensive to manufacture, it being made entirely, or nearly entirely, of plastic materials. Only a small quantity of materials is necessary. However, the great advantage is that it carries its own supply of toothpaste, which is a great advantage both at home, and in traveling, since it is not necessary to locate a separate supply of toothpaste, for use with the brush. Upon depletion of the supply of the toothpaste, the entire item can be discarded, in accordance with a main object of the invention.

The adapters 32 and 52 may occupy a considerable portion of the length of the handle. These fittings are relatively rigid, as noted above, and the length of the bellows need not be great to contain the desired quantity of toothpaste, and it maybe relatively short. Accordingly the two adapters 32, 52 together with the bellows, occupy a length such that the two adapters can be enclosed in the hand in the use of the toothbrush, producing an effect similar to a rigid handle. Therefore the handle may be considered relatively rigid when in its straight position and being used.

We claim:

1. A disposable toothbrush having a front end and a rear end, comprising, a main body, a brush head at the front end, a midsection including a flexible portion and defining a reservoir for containing toothpaste, and having a passage leading from the reservoir rearwardly and terminating in a nozzle at the rear end opening to the exterior, said flexible portion enabling the toothbrush to be bent to thereby place said nozzle in discharging relation to the bristles, and said flexible portion being operable upon flexing thereof for pumping toothpaste from the reservoir, said passage, and said nozzle onto the bristles.

2. A disposable toothbrush according to claim 1 wherein, the body includes external knobs adjacent its rear end, capable of being engaged by the hand for manipulating the flexible portion in the bending and pumping action thereof.

3. A toothbrush according to claim 1 wherein, said midsection includes a corrugated tubular wall constituting means directly defining the reservoir and constituting said flexible portion.

4. A disposable toothbrush according to claim 1 wherein, the toothbrush a frame which includes said flexible portion, and the frame has a normal, inactive and unbent position in which it is relatively straight, and the frame when in said inactive position being capable of being held in the hand, and when so held, constituting a semi-rigid handle.

5. A disposable toothbrush according to claim 4 wherein, the frame includes a front portion and a rear portion with said flexible portion therebetween, said front and rear portions being of rigid character and being capable, together with said flexible portion, and notwithstanding the flexibility of said flexible portion, of so constituting said semi-rigid handle.

6. A disposable toothbrush according to claim 1 wherein, the bristles extend laterally, and the nozzle opens laterally, from the longitudinal dimension of the toothbrush.

7. A disposable toothbrush according to claim 6 wherein, the rear portion includes a terminal element of substantially smaller transverse dimension than the remainder of the toothbrush defining said nozzle, and the toothbrush includes a removable cap normally enclosing the nozzle, in surrounding and frictional relation to said terminal element.

8. A disposable toothbrush according to claim 1 and including, an outer enclosing sleeve surrounding the body and secured at its front sleeve to the front end of the body, the outer enclosing sleeve being longitudinally contractible and extendible and when in extended position reaching at least to adjacent the rear end of the body.

9. A disposable toothbrush according to claim 8 wherein, the outer enclosing sleeve when in extended position reaching beyond the rear end of the body.

10. A disposable toothbrush according to claim 8 wherein, the outer enclosing sleeve when in extended position being rigid relative to said flexible portion and serving as a handle to the toothbrush.

* * * * *